US009499306B2

(12) United States Patent
Miller et al.

(10) Patent No.: US 9,499,306 B2
(45) Date of Patent: Nov. 22, 2016

(54) GIFT BAG WITH INTEGRAL CANDY DISPENSER

(71) Applicant: American Greetings Corporation, Cleveland, OH (US)

(72) Inventors: Carol Miller, Twinsburg, OH (US); Dave Mayer, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/456,925

(22) Filed: Aug. 11, 2014

(65) Prior Publication Data

US 2015/0210434 A1 Jul. 30, 2015

Related U.S. Application Data

(60) Provisional application No. 61/931,837, filed on Jan. 27, 2014.

(51) Int. Cl.

| | |
|---|---|
| ***B65D 30/22*** | (2006.01) |
| ***B65D 33/24*** | (2006.01) |
| ***B65D 33/00*** | (2006.01) |
| ***B65D 83/04*** | (2006.01) |
| ***B65D 85/60*** | (2006.01) |

(52) U.S. Cl.

CPC ..... *B65D 31/12* (2013.01); *B65D 33/00* (2013.01); *B65D 33/24* (2013.01); *B65D 83/04* (2013.01); *B65D 85/60* (2013.01)

(58) Field of Classification Search

CPC .. B65D 31/16; B65D 33/004; B65D 81/368; B65D 31/12; B65D 81/3261; B65D 29/00; B65D 33/24; B65D 33/00; B65D 83/04; B65D 85/60; A45C 13/08; A45C 3/00; A45C 13/02; A45C 13/42; G09F 23/00; G09F 23/10

USPC ..... 383/38–40; 206/783, 779, 775, 804

See application file for complete search history.

(56) References Cited

U.S. PATENT DOCUMENTS

| | | | | |
|---|---|---|---|---|
| 2,778,546 A | | 12/1953 | Klausmann | |
| 3,164,187 A | * | 1/1965 | Simmons | A45C 7/0072 150/112 |
| 5,490,623 A | * | 2/1996 | McConnell | B60R 7/043 206/233 |
| 5,613,312 A | * | 3/1997 | Crowell | A45C 13/08 206/457 |

(Continued)

FOREIGN PATENT DOCUMENTS

| | | |
|---|---|---|
| EP | 2177448 A1 | 4/2010 |
| EP | 2700590 | 8/2012 |

(Continued)

*Primary Examiner* — Peter Helvey

(74) *Attorney, Agent, or Firm* — Christine Flanagan

(57) ABSTRACT

A gift bag is provided having a generally traditional gift bag configuration with four side panels, a closed end and an open end opposite the closed end for inserting therein and removing therefrom a gift or other such item. At least one of the side panels of the gift bag is double-walled, thereby forming a cavity within the gift bag. A plurality of candy pieces is contained within the cavity. A candy dispenser is integral with the gift bag having a container into which one or more of the plurality of candy pieces may enter after exiting the cavity through a small opening therein. Once the candy dispenser is moved to an open position, a user can remove the candy therefrom and then move the candy dispenser back to a closed position in order to contain the remainder of the plurality of candy pieces within the gift bag.

20 Claims, 3 Drawing Sheets

(56) References Cited

U.S. PATENT DOCUMENTS

| | | | | |
|---|---|---|---|---|
| 5,735,548 | A * | 4/1998 | Anderson | B65D 77/04 283/74 |
| 5,836,095 | A * | 11/1998 | Crowell | A45C 13/08 383/106 |
| 6,234,677 | B1 * | 5/2001 | Mogil | A45C 7/0077 206/545 |
| 6,254,907 | B1 * | 7/2001 | Galomb | B65D 51/247 206/541 |
| 6,749,064 | B1 * | 6/2004 | Alrey | B65D 33/04 206/457 |
| D494,853 | S | 8/2004 | Chan | |
| 7,040,528 | B2 * | 5/2006 | Hengami | B65D 75/5894 222/505 |
| D547,673 | S | 7/2007 | Glass | |
| D548,107 | S | 8/2007 | Glass | |
| 2002/0088730 | A1 * | 7/2002 | Galomb | B31B 41/00 206/459.5 |
| 2003/0136623 | A1 * | 7/2003 | Renz | A45C 3/06 190/111 |
| 2006/0201979 | A1 * | 9/2006 | Achilles | A45C 13/02 224/411 |
| 2012/0257843 | A1 * | 10/2012 | McCann | B65D 31/10 383/10 |

FOREIGN PATENT DOCUMENTS

| | | |
|---|---|---|
| GB | 1121514 | 12/1965 |
| WO | WO2015036970 | 3/2015 |

* cited by examiner

GIFT BAG WITH INTEGRAL CANDY DISPENSER

RELATED APPLICATIONS

This application is a non-provisional of U.S. Provisional Patent No. 61/931,837, filed on Jan. 27, 2014, a copy of which is incorporated herein by reference in its entirety.

FIELD OF THE INVENTION

The present invention is in the field of greeting cards, gift wrap and other social expression products. More specifically, the invention is directed to a gift bag having a candy dispenser.

SUMMARY OF THE INVENTION

The present invention is directed to a gift bag having an attached and integral candy dispenser. The gift bag is generally rectangular, having four side walls, one closed end and one open end for inserting a gift or other object therein. One of the main gift bag panels is double-walled. A plurality of candy items, such as gumballs, jelly beans, M&Ms®, or other such small candy pieces is contained within a pocket or container created between the double walled gift bag panel. One side of the gift bag contains a candy dispenser for retrieving the candy from the pocket or container.

DETAILED DESCRIPTION OF PREFERRED AND ALTERNATE EMBODIMENTS

Figure 2:
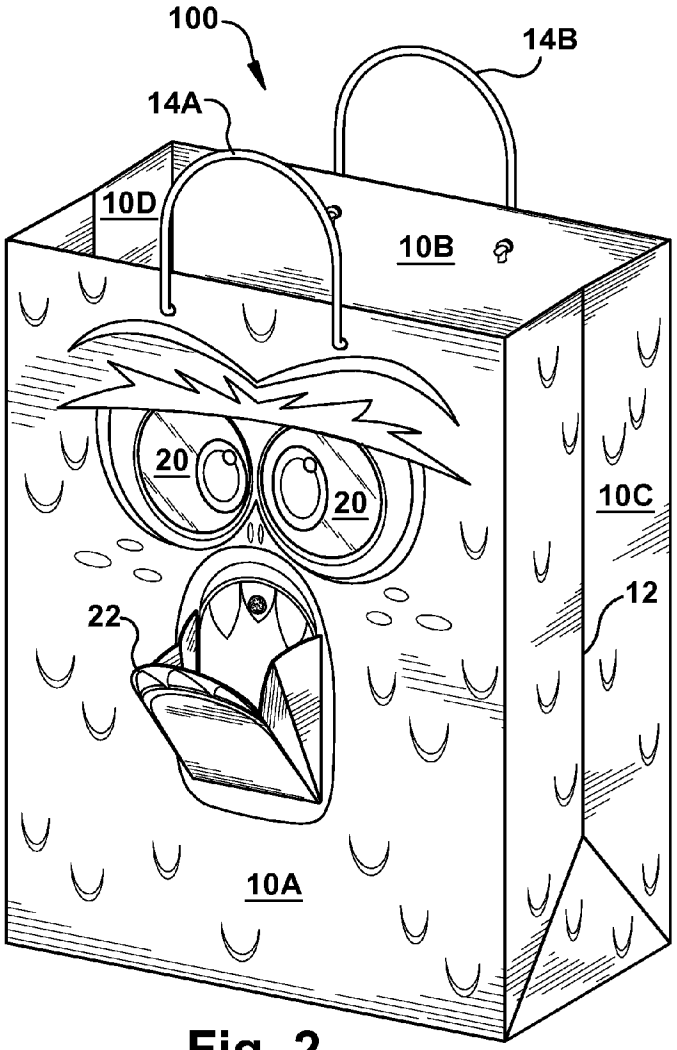
FIG. 2 is a perspective view of the gift bag of FIG. 1, with open dispenser.

The gift bag of the present invention includes a traditional gift bag enclosure with an attached and integral candy container and dispenser for removing a plurality of candy pieces from the candy container located within the gift bag.

The gift bag 100 contains two main panels 10A, 10B, spaced apart and parallel to one another, two side panels 10C, 10D which span between and connect the two main panels 10A, 10B, and a bottom panel which is attached to both main panels 10A, 10B and both side panels 10C, 10D, creating a closed end to the gift bag 100. The end opposite the closed end is open for the insertion of a gift or other item into the gift bag 100. The side panels 10C, 10D may contain a vertical bisecting crease or fold line 12 which enables the bag 100 to be neatly folded and packaged for retail sale. The gift bag panels 10A-10D are generally shaped like the traditional rectangular gift bag, but may come in various sizes. The edges of the gift bag are generally liner but may have one or more non-linear edges to add to the decorative effect of the gift bag 100. The gift bag 100 may also contain two handles 14A, 14B, one handle 14A attached to a first main panel 10A and one handle 14B attached to a second main panel 10B. The handles 14A, 14B may be similar to a cord or rope-like material, which extend between two holes or openings on an upper edge of the main gift bag panels 10A, 10B along the open end of the gift bag 100. For each handle 14A, 14B, a single piece of cord or rope-like material is used. Two free ends of a first cord are inserted into the two holes or openings in a first main panel 10A of the gift bag 100 and two free ends of a second cord are inserted into the two holes or openings in a second main panel 10B of the gift bag 100. The cords may be inserted into each hole from the outside of the bag to the inside of the bag where each free end of the cord is tied or knotted for secure attachment to the gift bag 100. Alternatively, the cords may be inserted from the inside of the gift bag to the outside of the bag, where each free end is then tied or knotted. Other types of handles may be used as well made from material such as cardstock, cardboard, foam, rubber, plastic or other woven or non-woven material. These handles may be attached to the gift bag using a variety of attachment mechanisms, such as snaps, hooks, rivets, Velcro™, or adhesive. The gift bag 100 may be displayed at retail in a flat, folded position. A small retail hangtag may be removably attached to an inner surface of the gift bag 100 so that the folded gift bag 100 may be suspended from a hanger attached to a retail display. The gift bag 100 may be made of heavy-gauge paper, plastic, or other lightweight material. Additionally, the entire outer surface of the gift bag 100 or portions thereof may contain fur (such as to resemble an animal or monster) or other tactile material. Also, two or more materials may be combined to cover the entire outer surface of the gift bag 100 or portions thereof.

Figure 1:
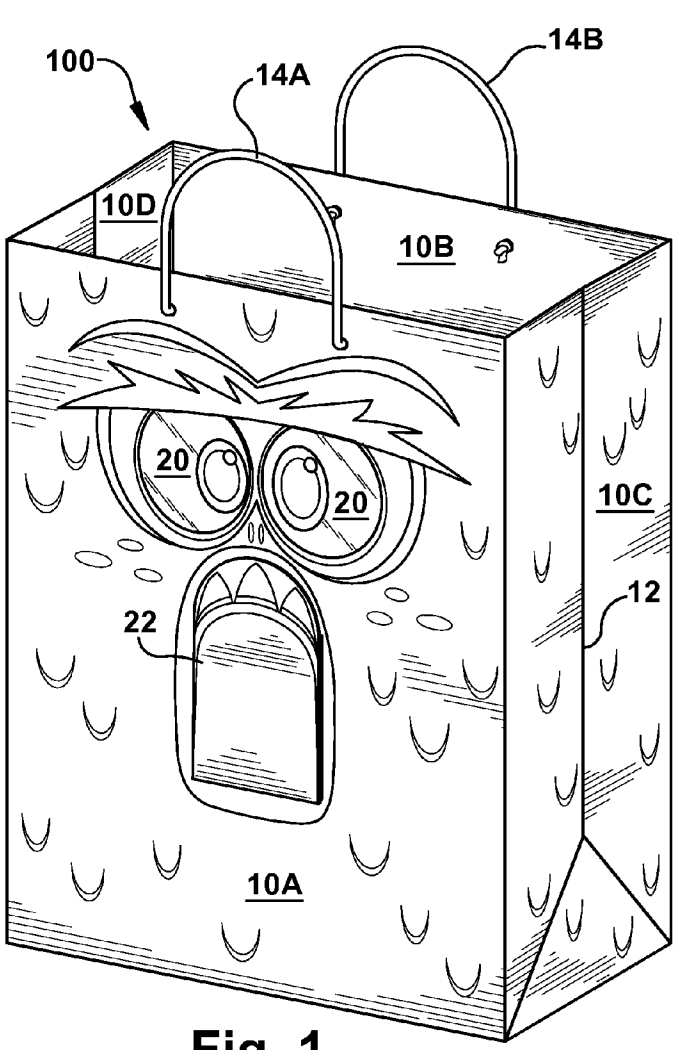
FIG. 1 is a perspective view of the gift bag with candy dispenser of the present invention, with closed dispenser.
Figure 4:
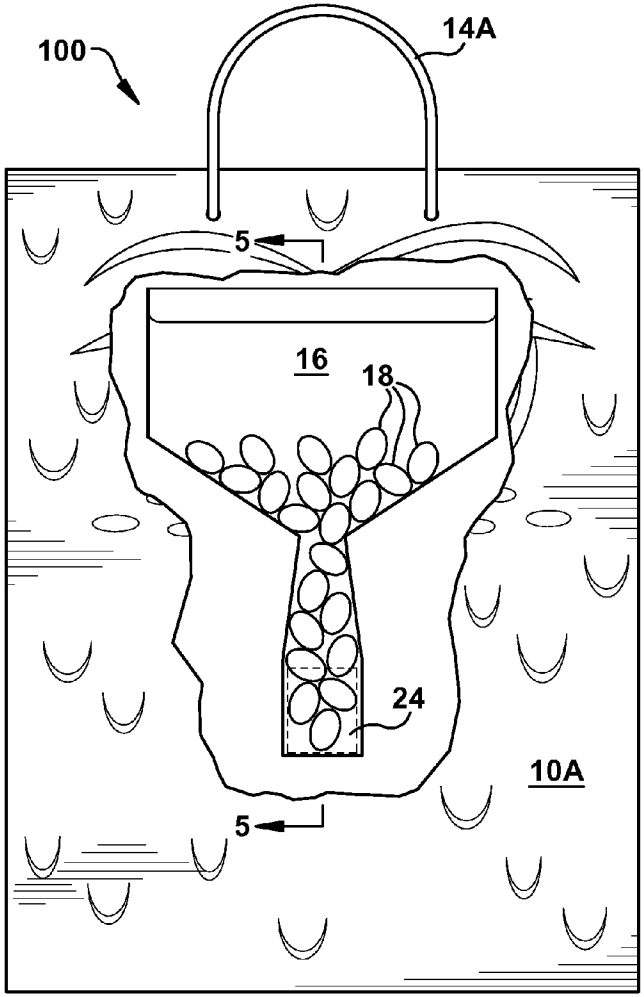
FIG. 4 is a front tear-away view of the gift bag of FIG. 1.

The gift bag 100 can be used like a typical gift bag, such as, for inserting a gift therein for presentation to the gift recipient. However, this bag can continue to be used by the gift recipient as a novelty bag or storage container. At least one panel of the gift bag is a double-walled panel having two plies or layers which form a cavity or pocket 16 therebetween. Alternately, instead of the entire panel being a double-walled panel, a shaped cavity or container can be attached to or integral with the inside surface of one of the main panels 10A, 10B of the gift bag 100. A plurality of candy pieces 18 may be contained in the cavity or pocket 16 to provide an added surprise or gift to the gift bag recipient. The plurality of candy pieces 18 may be contained in the cavity 16 upon purchase of the gift bag 100, or in the preferred embodiment, the cavity 16 is empty upon purchase, allowing the consumer to select and fill the cavity 16 with the candy 18 of his/her choosing. The plurality of candy pieces 18 may be mints, gumballs, jelly beans, or other relatively small hard tack candy. One of the main panels of the gift bag 10A, 10B may contain artwork, text or other printing thereon which resembles a character, such as a monster, as shown in FIGS. 1 and 2. The cavity or pocket 16 may have a larger space in an upper portion of the gift bag 100 which tapers to a narrow funnel-like space leading downward toward the dispenser 22, as shown in FIG. 4. The cavity or pocket 16 may contain a flap or other such device thereon which allows access to the inside of the cavity 16. The flap can be used to open and close the cavity 16 in order to add additional candy 18 thereto or to refill the cavity 16 with candy 18 once it has been depleted. A portion of the bag design on the front face may contain at least one cut-out which is covered by a transparent or see-through panel 20, through which candy 18 contained inside the cavity 16 can be seen (when cavity is filled). For example, in the gift bag 100 shown in FIG. 1, the gift bag 100 is printed with the face of a monster. The eyes of the monster have a cut-out which is covered by a transparent material 20. The candy 18 may be seen through this material 20.

Figure 3:
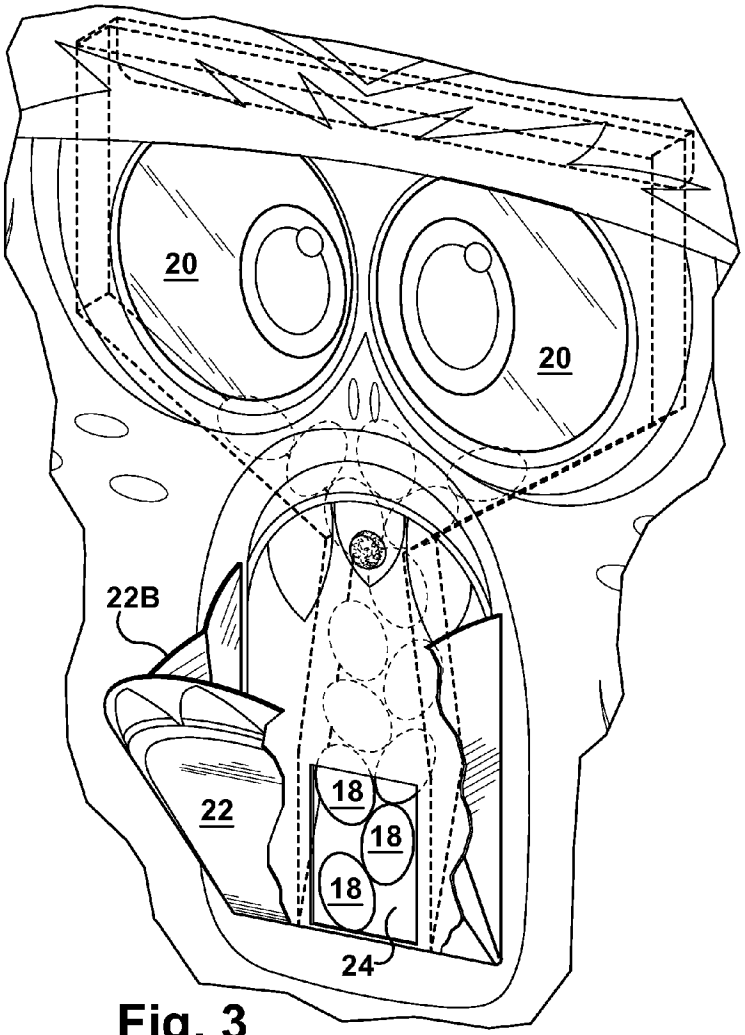
FIG. 3 is a perspective tear-away view of the gift bag of FIG. 1.
Figure 5:
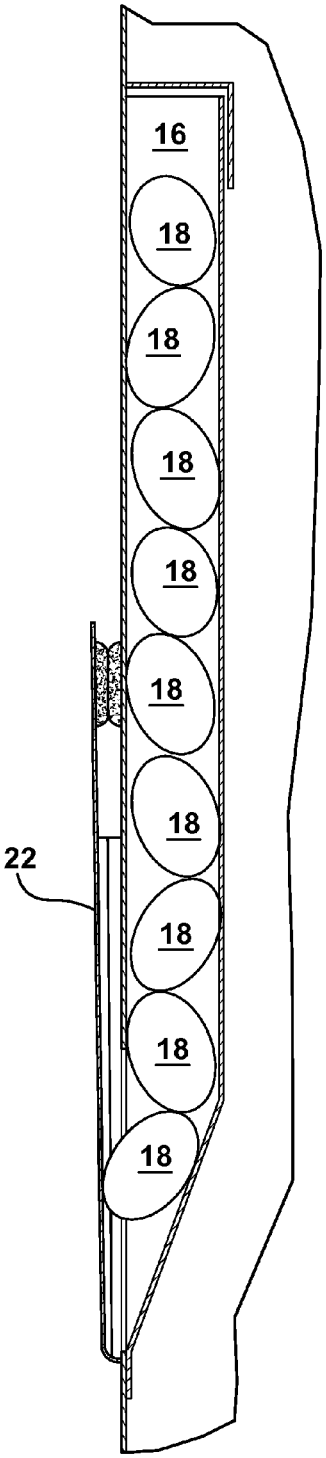
FIG. 5 is a profile view of the candy dispenser portion of the gift bag of FIG. 1, with a closed dispenser.
Figure 6:
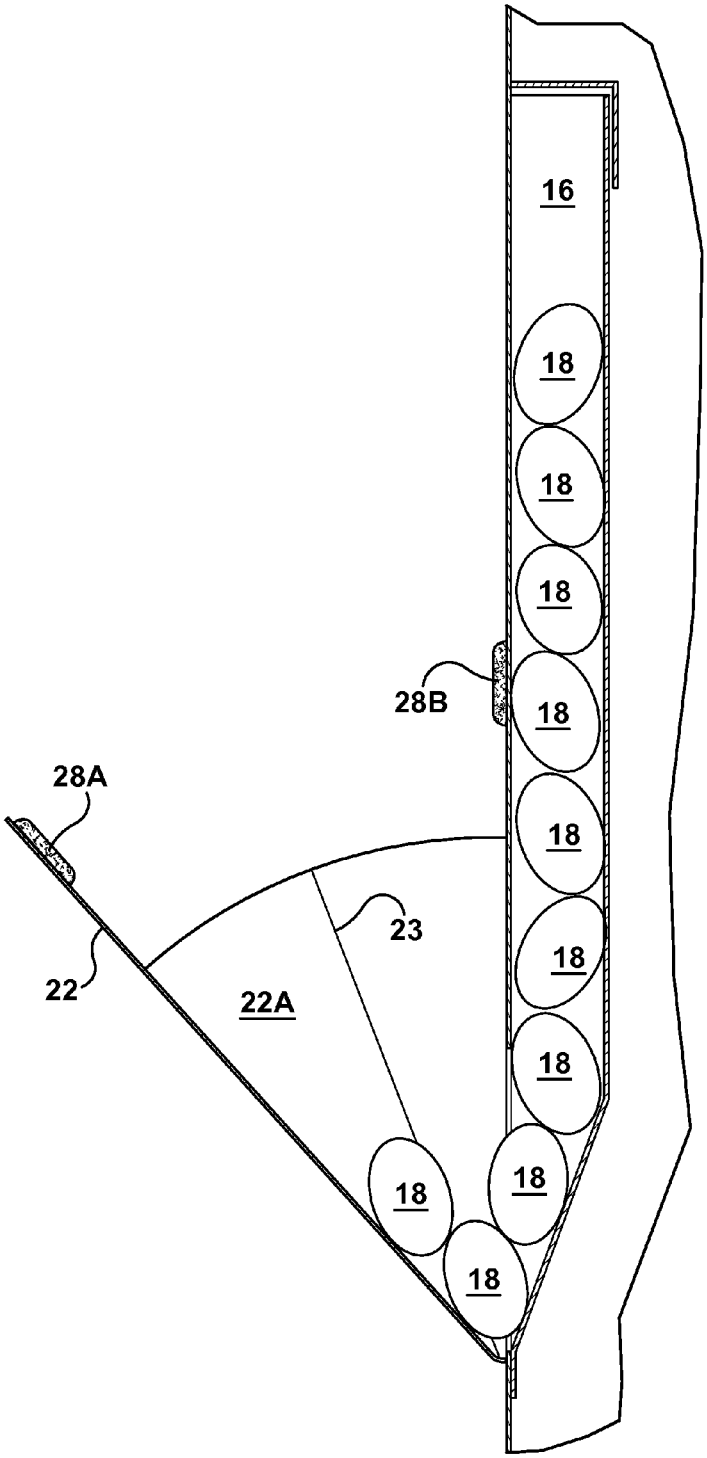
FIG. 6 is a profile view of the candy dispenser portion of the gift bag of FIG. 1, with an open dispenser.

The candy 18 can be removed from the gift bag 100 by using the integral candy dispenser 22. The candy dispenser 22 is decorated to correspond to the mouth of the face depicted on the front of the gift bag 100. For example, as shown in FIG. 1, the dispenser 22 looks like the mouth of the monster. The dispenser 22 pulls out or away from the gift bag 100 and forms a small cup-like structure into which the candy 18 will flow out from an opening 24 in the container in which the candy 18 is enclosed (shown in FIGS. 3 and 4). The opening 24 through which the candy 18 flows through into the dispenser 22 is large enough so that more than one piece of candy 18 can flow through the opening 24 but also small enough so that all of the candy 18 will not flood through the opening into the dispenser all at once, as shown in FIG. 4. The dispenser 22 contains two side panels 22A, 22B which each have a bisecting crease or fold line 23 so that the dispenser 22 can easily be moved out away from the gift bag 100 (by unfolding the crease) and moved back toward the gift bag 100 (by re-folding along the crease) to close the dispenser 22. A hook and loop fastener 26 is used to keep the dispenser 22 in the closed position. A small loop patch 28A is contained on the dispenser 22 which matches in size, shape and location to small hook patch 28B which is contained on the gift bag 100 so that the when the dispenser 22 is moved to the closed position the hook patch 28A catches the loop patch 28B to firmly hold the dispenser 22 in the closed position, as shown in FIG. 5. Tearing the hook patch 28A away from the loop patch 28B moves the dispenser to the open position, as shown in FIG. 6. Other types of candy dispensing devices have been contemplated and are considered to be within the scope of the present invention. At retail or before purchase by a consumer, the gift bag 100 may contain a piece of tape or other transparent material over the opening 24 through which the candy 18 exits the gift bag 100 to prevent the candy 18 from flowing through the opening 24 upon the opening the dispenser 22 prior to purchase. This tape or other material can easily be removed by pealing it away from the opening 24 upon purchase of the gift bag.

In another embodiment, both of the main gift bag panels may be double-walled or have a cavity contained therein and each main panel may contain a separate dispenser 22 such that each side of the bag contains a candy dispenser 22. The opposing sides may contain different artwork thereon to create different faces or to create other opposing artwork. The two candy dispensers 22 may also contain different types of candy 18 therein.

While various sizes, shapes, designs and materials have been described and shown herein, they are not meant to limit the invention in any way. Alternative sizes, shapes, designs, and materials have been contemplated and are considered to be within the scope of the present invention. Different gift bag sizes may contain a smaller cavity which can accommodate a smaller portion of candy. The number of candy dispensers, number of covered openings in the gift bag through which candy may be visible has been described and shown in the Figures as two separate covered openings (e.g. eyes on the monster face), however any number of covered openings may be present, including no covered openings through which the candy is visible. One or more materials may be used to cover the outer surface of the gift bag or a single material may be used for the entire outside surface of the gift bag. Additional embellishments may be used to decorate the gift bag, including googly eyes, grommets, gems, or other three-dimensional trimmings. While hook and loop patches have been described herein as the mechanism to open and close the candy dispenser, other attachment mechanisms may be used (e.g., magnets, string, etc.) and are considered to be within the scope of the present invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A gift bag comprising:

a bag having four sides, a closed end and an open end opposite the closed end, the bag having an opening contained on one of the four sides;

an insert having a main panel and a perimeter which connects the main panel to an inside surface of the bag over the opening forming a cavity therebetween;

a dispenser overlying the opening on an outside surface of the bag, the dispenser comprising at least three panels and operative to move between an open and a closed position;

wherein opening the dispenser causes the contents of the cavity to exit the bag through the opening and fill the dispenser.

2. The gift bag of claim 1, wherein the bag contains at least one covered opening thereon through which contents of the cavity are visible.

3. The gift bag of claim 1, wherein the cavity contains a flap thereon which allows access to the inside of the cavity.

4. The gift bag of claim 1 further comprising a plurality of candy pieces contained within the cavity.

5. The gift bag of claim 1, wherein a hook patch contained on the dispenser attaches to a loop patch on the bag for maintaining the dispenser in a closed position.

6. The gift bag of claim 5, wherein the dispenser may be opened by pulling the hook patch away from the loop patch.

7. The gift bag of claim 1 further comprising two handle attached to an upper surface of the bag proximate to the open end of the bag.

8. A gift bag comprising:

a bag having a first main panel and a second main panel which are parallel and spaced apart from each other, two side panels which extend between the first and second main panels, and a bottom panel which is attached to the first and second main panels and the two side panels to form a closed end of the bag, the opposite end of the bag being open for the insertion of an item therein;

a cavity which is attached to an inside surface of the first main panel of the bag;

a foldable pocket attached to an outside surface of the first main panel of the bag, the pocket operative to move between an open position and a closed position;

the bag having an opening thereon between the cavity and the pocket;

wherein contents inserted into the cavity are in direct contact with the inside surface of the first main panel of the bag; and wherein having the foldable pocket in a closed position maintains contents of the cavity within the cavity and having the foldable pocket in an open position causes the contents of the cavity to exit the cavity and enter the foldable pocket through the opening in the bag.

9. The gift bag of claim 8, wherein the cavity contains an open end through which items may be inserted therein.

10. The gift bag of claim 8, wherein the first main panel of the gift bag contains a second opening thereon through which the contents of the cavity are visible.

11. The gift bag of claim 10, wherein the second opening contains a transparent cover.

12. The gift bag of claim 8, wherein the foldable pocket contains three panels.

13. The gift bag of claim 12, wherein two of the three panels of the foldable pocket contain a bisecting fold line thereon.

14. The gift bag of claim 8, wherein the foldable pocket is held in a closed position by hook and loop patches.

15. The gift bag of claim 8 further comprising a plurality of candy pieces contained within the cavity.

16. A gift bag comprising:

a four-sided bag with an open end and a closed end;

a tapered insert having a rear surface and a perimeter which connects rear surface of the tapered insert to an inside surface of the four-sided bag creating a closed cavity, wherein contents placed into the cavity are contained between the tapered insert and the four-sided bag;

a dispenser compartment which when in a closed position, maintains the contents of the cavity within the cavity and when in an open position, allows the contents of the cavity to move out of the cavity through an opening in the four-sided bag and into the dispenser compartment.

17. The gift bag of claim 16, wherein the dispenser compartment is held in the closed position by hook and loop patches.

18. The gift bag of claim 16, wherein the cavity contains a moveable flap on a top edge thereof which provides access to the cavity.

19. The gift bag of claim 16, wherein the four-sided bag contains at least one covered opening thereon through which the contents of the cavity are visible.

20. The gift bag of claim 16, wherein a plurality of candy pieces are contained within the cavity.

* * * * *